US009309098B2

(12) United States Patent
Lindenmuth et al.

(10) Patent No.: US 9,309,098 B2
(45) Date of Patent: Apr. 12, 2016

(54) PALLET FORK WITH IMPROVED VISIBILITY AND VERSATILITY

(75) Inventors: Karl E. Lindenmuth, Wamego, KS (US); Richard K. Oswald, Onaga, KS (US); Daniel E. Peschel, Manhattan, KS (US); Andrew L. Vering, Manhattan, KS (US); Rayme J. Collins, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 2076 days.

(21) Appl. No.: 12/326,994

(22) Filed: Dec. 3, 2008

(65) Prior Publication Data

US 2010/0101895 A1 Apr. 29, 2010

Related U.S. Application Data

(60) Provisional application No. 61/108,458, filed on Oct. 24, 2008.

(51) Int. Cl.
*B66F 9/14* (2006.01)
*B66F 9/16* (2006.01)

(52) U.S. Cl.
CPC .. *B66F 9/142* (2013.01); *B66F 9/16* (2013.01)

(58) Field of Classification Search
CPC ..... B66F 9/16; B66F 9/142
USPC ..... 187/237; 414/631, 664, 668, 785, 667; 37/468
See application file for complete search history.

(56) References Cited

U.S. PATENT DOCUMENTS

| | | | | | |
|---|---|---|---|---|---|
| 3,754,673 | A * | 8/1973 | Barda et al. | 414/667 |
| 3,760,883 | A * | 9/1973 | Birk | 172/273 |
| 4,189,275 | A * | 2/1980 | Arnold | 414/640 |
| 4,392,773 | A * | 7/1983 | Johannson | 414/667 |
| 4,643,631 | A * | 2/1987 | Maurer et al. | 414/723 |
| 4,809,449 | A * | 3/1989 | Solaja | 37/407 |
| 4,986,721 | A * | 1/1991 | Lowder et al. | 414/685 |
| 5,139,385 | A * | 8/1992 | Chase et al. | 414/667 |
| 5,685,689 | A * | 11/1997 | Schneider et al. | 414/723 |
| 5,732,488 | A * | 3/1998 | Smith | 37/468 |
| 6,132,164 | A * | 10/2000 | Way et al. | 414/685 |
| 6,196,595 | B1 * | 3/2001 | Sonerud | 285/26 |
| 6,533,526 | B2 * | 3/2003 | Lindgren et al. | 414/667 |
| 6,860,706 | B2 * | 3/2005 | Godwin et al. | 414/723 |
| 6,969,225 | B2 * | 11/2005 | Mensch | 414/685 |
| 7,014,385 | B2 * | 3/2006 | Lim et al. | 403/322.4 |
| 7,168,908 | B2 * | 1/2007 | Diaz et al. | 414/723 |
| 7,182,546 | B1 * | 2/2007 | Kimble | 403/322.3 |
| 2007/0245603 | A1 * | 10/2007 | Vering et al. | 37/468 |

OTHER PUBLICATIONS

"Loader Forks for Cat Wheel Loaders," 7 pages, 2001.
"Cat Fusion Pallet Forks for 924-972, IT38, IT62 H- and G- series Wheel Loaders, Product Bulletin," 84 pages, Jun. 2008.

* cited by examiner

*Primary Examiner* — William E Dondero
*Assistant Examiner* — Minh Truong
(74) *Attorney, Agent, or Firm* — Miller, Matthias & Hull LLP

(57) ABSTRACT

A pallet fork includes a structural frame, a fork bar, a swing bar, and a pair of fork tines. The fork tines can be fixed or swinging through the removal of the swing bar. The swing bar can be conveniently stored onboard the pallet fork when it is inoperative. The structural frame is arranged for enhanced visibility by an operator to the fork tines to improve productivity and operator comfort.

12 Claims, 3 Drawing Sheets

PALLET FORK WITH IMPROVED VISIBILITY AND VERSATILITY

This application claims the benefit of U.S. provisional patent application No. 61/108,803, filed Oct. 24, 2008.

TECHNICAL FIELD

The field of this invention is implements for lifting loads, and more specifically a pallet fork attachment for a wheel loader or other machinery.

BACKGROUND

Pallets are widely used to hold and transport many different types of loads. Pallet forks are implements used to lift and transport palletized loads. The designs or dimensions for pallets are semi-standardized or customary, so pallet forks can be made which will be able to pickup a majority of pallets encountered. Pallets and pallet forks are versatile tools, and are a widely accepted and commonly used in manufacturing, construction, warehousing, transportation, retailing, and other commercial environments.

Pallet forks can be used on construction sites to pickup and transport building materials on pallets. For example, palletized building materials may arrive at a building site on a flat bed trailer, and can be unloaded and transported with a pallet fork to a storage area on the site. There are often several different construction machines available on a building site which can use a pallet fork as an implement. These include wheel loaders, back hoe loaders, telehandlers, and forklifts. In addition to lifting and transporting palletized building materials, a machine with a pallet fork can also pickup a wide variety of non-palletized materials. For example, a pallet fork may be used to pickup sheets of wood building materials, bundles of roofing shingles, large concrete or steel pipes, large tool chests, hoppers for concrete or gravel, etc.

Productivity when using a pallet fork can depend in large part upon visibility. Especially when a pallet fork is used as an attachment on a wheel loader or back hoe loader or similar equipment, visibility may be compromised to the detriment of productivity and also operator comfort. By visibility, we mean the ability to see the fork tines—especially the tips of the fork tines—and the pallet or load, in order to quickly and accurately aim the movement and positioning of the fork tines underneath the pallet or load, and then the movement and positioning of the pallet or load before setting it down.

Some pallet fork designs used in the past have not always permitted easy visibility to the fork tines. Especially when the fork tines are adjustable within a range of different spreads, certain positions of the fork tines result in poor visibility.

Fork tines can be fixed to the pallet fork, or be allowed to swing when the pallet fork tilts forward. Some pallet forks have fixed tines, some have swinging tines, and some are adjustable with tines that can be selectively set for fixed operation or swinging. Adjustable pallet forks have mechanisms for fixing the tines and releasing them so they can swing. But the prior art mechanisms for fixing tines have not always been as reliable or simple as they could be.

DETAILED DESCRIPTION

Figure 1:
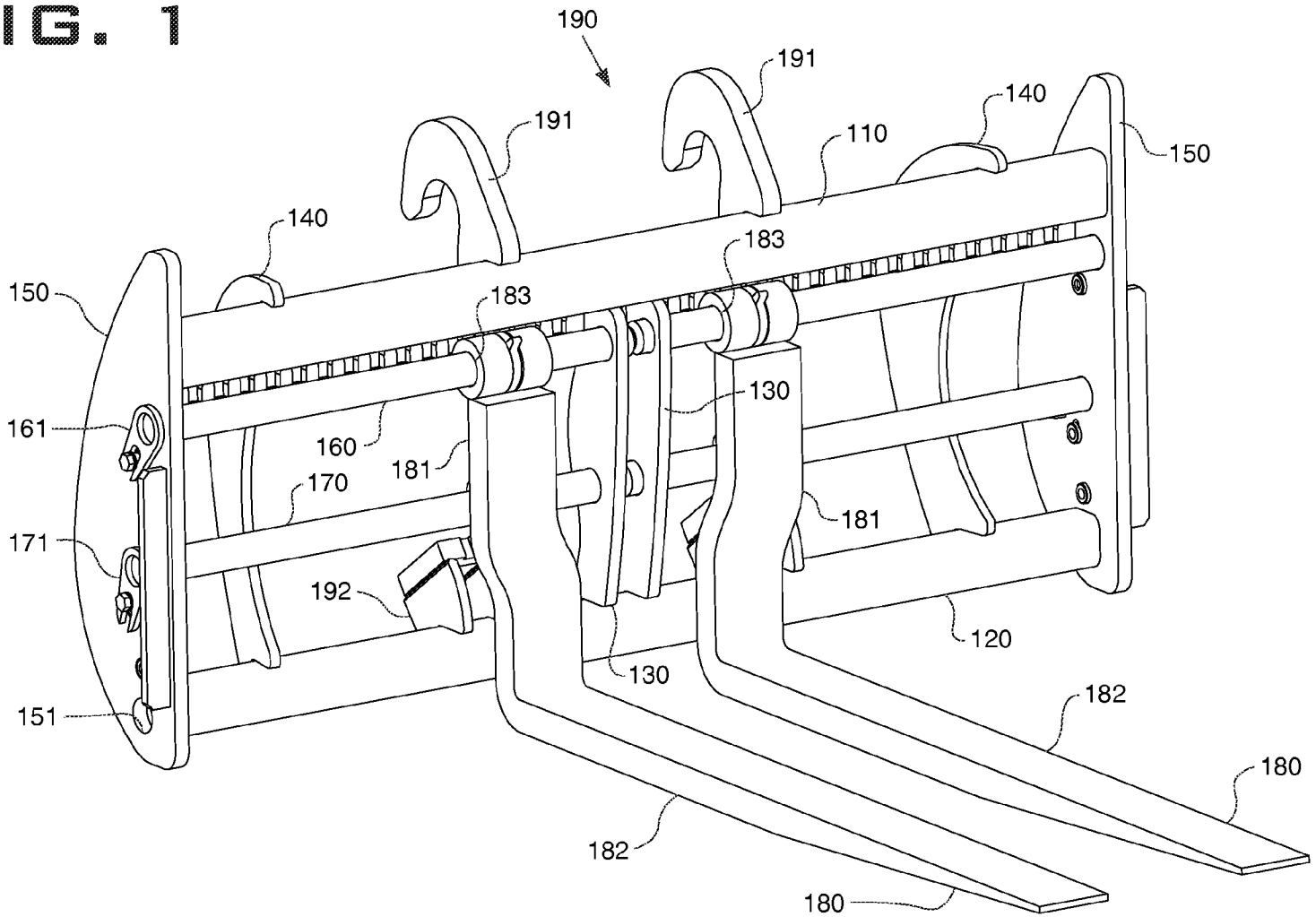
FIG. 1 is an isometric view of a pallet fork constructed according to the principles of the present invention.

The following is a detailed description of exemplary embodiments of the invention. The exemplary embodiments described herein and illustrated in the drawing figures are intended to teach the principles of the invention, enabling those of ordinary skill in this art to make and use the invention in many different environments and for many different applications. The exemplary embodiments should not be considered as a limiting description of the scope of patent protection. The scope of patent protection shall be defined by the appended claims, and is intended to be broader than the specific exemplary embodiments described herein.

Figure 2:
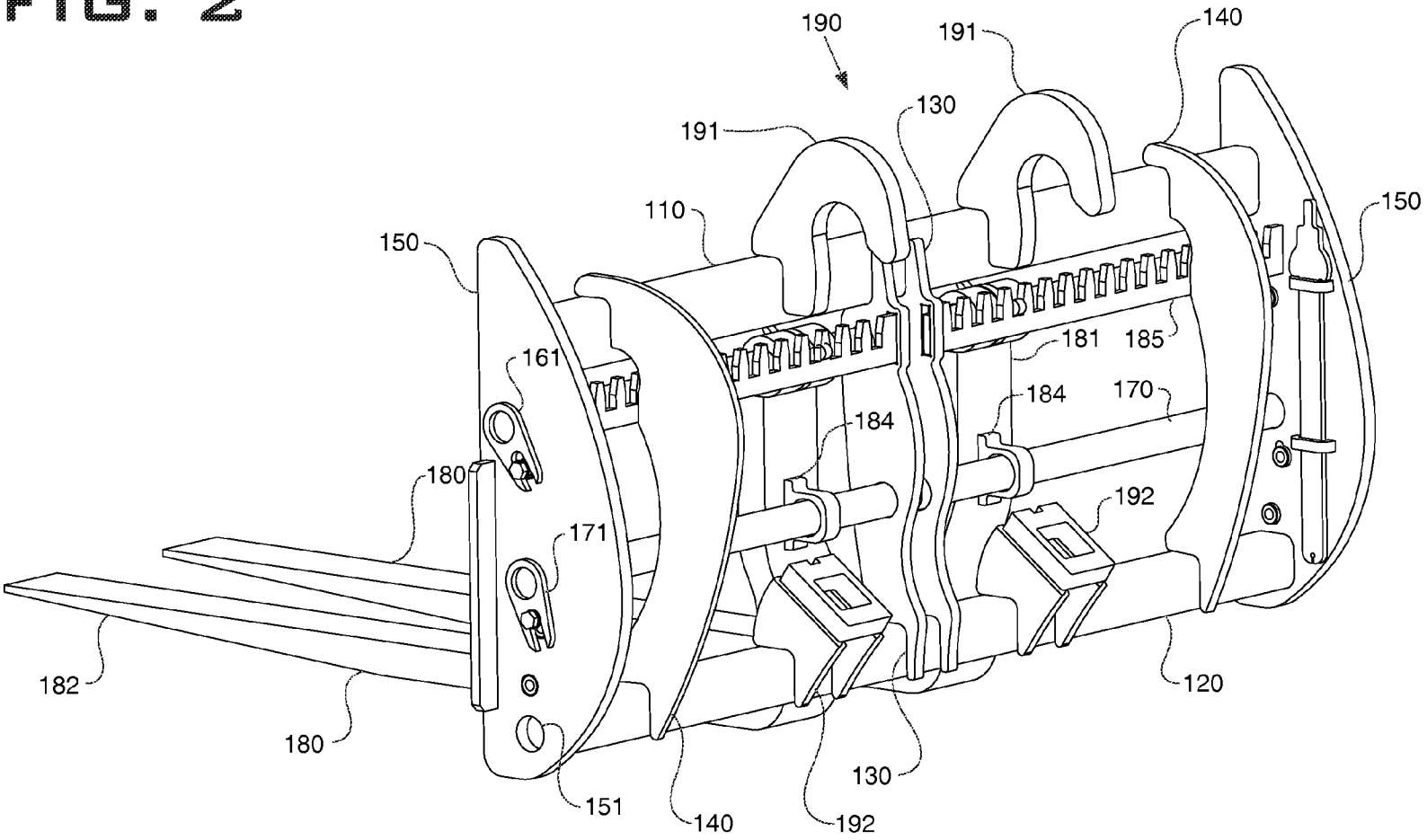
FIG. 2 is another isometric view of the pallet fork of FIG. 1.
Figure 3:
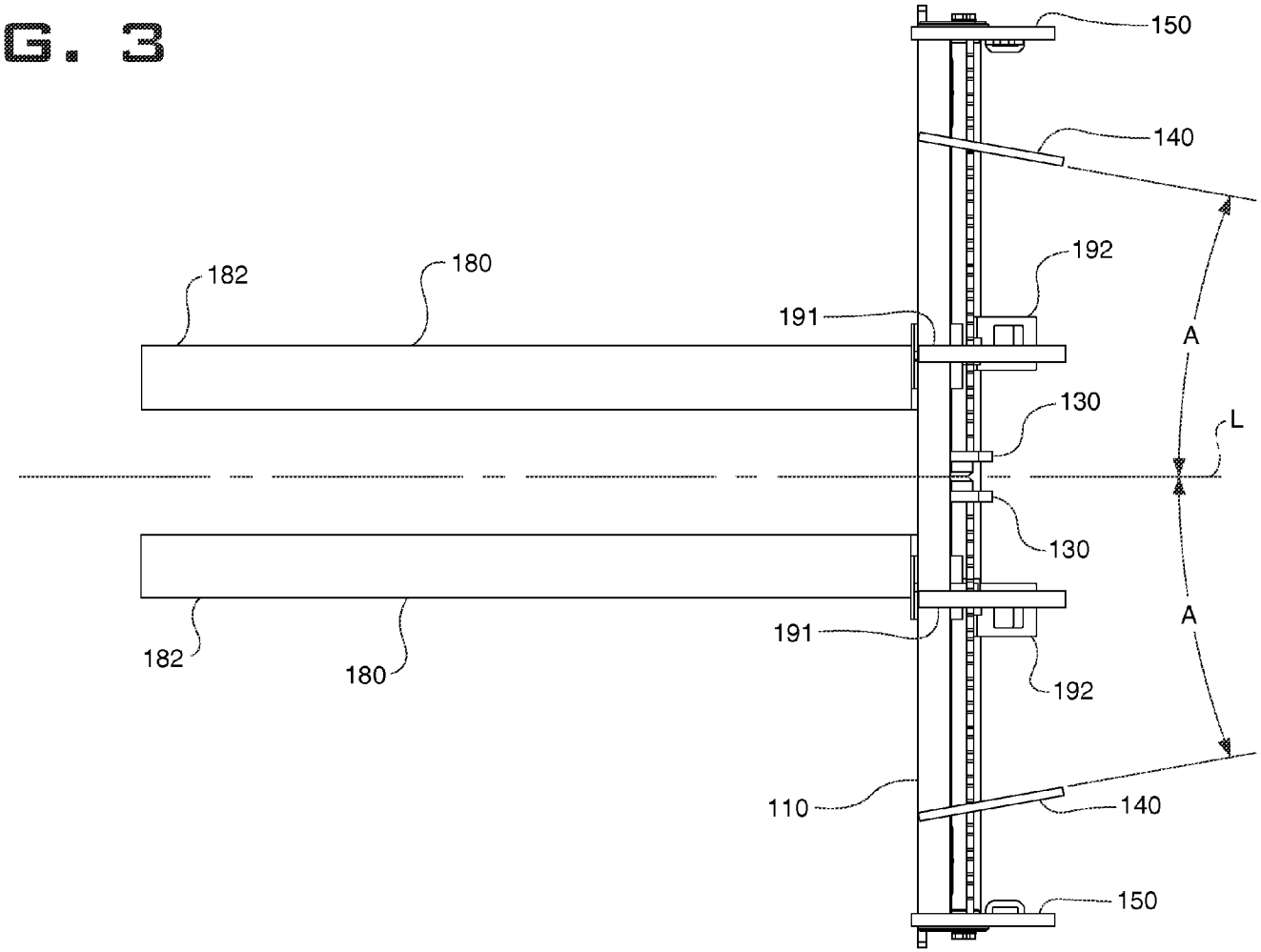
FIG. 3 is top view of the pallet fork of FIG. 1.

A pallet fork attachment 100 (or pallet fork 100) is shown in FIGS. 1-3. The pallet fork 100 has a structural frame. The structural frame could take many different forms as will be recognized by those of ordinary skill in this art. In the pictured embodiment the structural frame comprises a top tube 110 and a bottom tube 120. The top tube 110 and the bottom tube 120 together are the individual "backbone" structural members of the pallet fork 100 and are approximately parallel to one another. The top tube 110 and bottom tube 120 are tied together structurally by two sets of ribs, such as a set of inner ribs 130 and a set of outer ribs 140. The inner ribs 130 are the vertically oriented plates near the center point or midplane of top tube 110 and bottom tube 120. The inner ribs 130 are structurally joined to the top tube 110 and bottom tube 120 with a weld joint, or any other practical means. The inner ribs 130 can be approximately parallel to one another, and approximately normal to the top tube 110 and bottom tube 120. The inner ribs 130 are two separate plate-like members in the design shown in FIGS. 1-3, but could be formed as a single plate or other element, or more than two plates, as may be convenient in a particular design.

Likewise, the outer ribs 140 are the vertically oriented plates close to the ends of top tube 110 and bottom tube 120. The outer ribs 140 are structurally joined to the top tube 110 and bottom tube 120 with a weld joint, or any other practical means. The outer ribs 140 may be approximately parallel to one another, if desired, or could be angled to improve visibility, as will be described in more detail herein. The outer ribs 140 may also be approximately normal to the top tube 110 and bottom tube 120. The outer ribs 140 are two separate plate-like members, but could be formed as more than two individual plates or other elements, as may be convenient in a particular design.

The distal ends of top tube 110 and bottom tube 120 are joined by a pair of end plates 150. End plates 150 may be joined to the top tube 110 and bottom tube 120 with a weld joint or other practical means. End plates 150 may be vertically oriented plate-like members, and may be approximately parallel to one another and approximately normal to the top tube 110 and bottom tube 120.

A fork bar 160 and swing bar 170 are supported by the structural frame of the pallet fork 100. Fork bar 160 has a longitudinal axis which is parallel with the longitudinal axis of swing bar 170. In the pictured embodiment, fork bar 160 and swing bar 170 are supported by the end plates 150 and the inner ribs 130. They could also be supported by the outer ribs 140. The end plates 150 and inner plates 130 include parallel and aligned bores for supporting the fork bar 160 and swing bar 170. A flag 161 and flag 171 are attached to a distal end of each fork bar 160 and swing bar 170 and may be bolted to an end plate 150 to keep the bars from retracting out of the bores. The pallet fork 100 may include a single fork bar 160 and a single swing bar 170 spanning from one end plate 150 to the opposite end plate 150, or alternatively one or both bars may be divided into two separate bars, i.e. two fork bars 160 and two swing bars 170 as is shown in the design in FIGS. 1-3, and separately attached with flags on opposite end plates 150. Dividing the fork bar 160 and swing bar 170 into two separate bars each facilitates assembling and disassembling as each bar will be shorter and weigh less.

A pair of fork tines 180 are supported on the fork bar 160. Each tine has a vertical leg 181 and a horizontal leg 182 which are at approximately 90 degrees relative to one another. At the top of the vertical leg 181 is a bore 183 which receives the fork bar 160. Each fork tine 180 is free to swing about fork bar 160 at bore 183, unless it is constrained by swing bar 170. Each vertical leg 181 may include a lock 184 which is engageable with swing bar 170. In the illustrated embodiment, lock 184 is a block attached to the vertical leg 181 with a bore formed therein for receiving swing bar 170. Other types of locks could also be employed, as will be appreciated by those of ordinary skill in this art. When swing bar 170 is positioned as shown in FIGS. 1 and 2, and the locks 184 are engaged with the swing bar 170, the fork tines 180 are fixed and restricted from swinging. When swing bar 170 is removed, the fork tines 180 are free to swing around fork bar 160.

An operator may prefer to have fixed or swinging fork tines 180 depending upon personal preference and/or the work being performed by the pallet fork 1 00. If the fork tines 180 are fixed, swing bars 170 may be easily removed to convert to swinging fork tines. Swing bars 170 are removed by unbolting the flags 171 and pulling swing bars 170 out of the bores formed in the inner ribs 130 and end plates 150 in the direction of the longitudinal axis of the swing bar 170 and fork bar 160. Removing swing bars 170 from their operative positions releases them from locks 184. Swing bars 170 can be conveniently stored inside of bottom tube 120 in an inoperative position. Bores 151 have been formed on end plates 150 to allow swing bars 170 to be inserted into bottom tube 120 for onboard storage. In the onboard storage position, flags 171 can be bolted to end plates 150 for retention. Of course, on board storage of swing bars 170 may also be arranged inside of top tube 110 in a similar manner.

Fork tines 180 can be moved within a range of fork spreads (the lateral distance between the fork tines 180) by manually sliding the bores 183 along the length of fork bars 160. A locking bar 185 can be used to selectively engage with locking tabs on each fork tine 180 and hold it in a particular lateral position.

The structural frame may include an implement mounting system 190 for mounting pallet fork 100 as an implement to a wheel loader or other machine and may include a pair of hooks 191 and a pair of locking bar receptacles 192. Other implement mounting systems are possible and can be chosen according to convenience or application, as will be understood by those of ordinary skill in this art. Hooks 191 may be directly attached to top tube 110. Locking bar receptacles 192 may be directly attached to bottom tube 120.

The pallet fork 100 features enhanced visibility for an operator through the structural frame to the ends of fork tines 180 and to the load to be picked-up. This enhanced visibility can increase productivity and operator comfort. The enhanced visibility is provided in part by separating hooks 191 from inner ribs 130. If inner ribs 130 were placed farther apart than the position shown in FIGS. 1-3, then they could easily be integrally formed with hooks 191 as a single structural member stretching from bottom tube 120 to top tube 110 and continuing above top tube 110 to form the hooks 191. However, enhanced visibility is achieved by keeping inner ribs 130 close to the center line of the pallet fork 100. This creates wide windows of visibility through the structural frame between the inner ribs 130 and end plates 150 and between the top tube 110 and the bottom tube 120. With this enhancement, the ends of horizontal legs 182 of fork tines 180 can be viewed by an operator throughout a wider range of fork tine spreads.

Enhanced visibility is also provided by the angling of outer ribs 140, as best seen in the top view in FIG. 3 Outer ribs 140 are each oppositely angled with respect to a longitudinal centerline L of pallet fork 100 at an angle A preferably in a range of 5-20 degrees, more preferably in a range of 5-15 degrees, and most preferably at an angle of about 10 degrees. Positioning outer ribs 140 at angle A reduces the ribs' profile in the line of sight of the operator to further preserve the windows of visibility between inner ribs 130 and end plates 150.

Enhanced visibility can also be provided by offset fork tines. As shown in the illustrated design and most easily seen in FIG. 1, the fork tines 180 can be offset such that the centerline of the vertical leg 181 is not aligned with the centerline of the horizontal leg 182. This is usually accomplished by providing a bend in the vertical leg 181 so that an upper portion of the vertical leg has a first centerline and a lower portion of the vertical leg has a second, offset centerline. The upper portion of the vertical leg 181 should have a centerline which is farther from the centerline L of pallet fork 100 than the centerline of the horizontal leg 182. When the fork tines 180 are set close to one another and close to the centerline L of pallet fork 100, offset tines can preserve the operator's line of sight to the tips of the fork tines.

INDUSTRIAL APPLICABILITY

The pallet fork 100 has industrial applicability as an implement for picking-up and transporting palletized loads and non-palletized loads, in factory, warehousing, and construction environments.

We claim:

1. A pallet fork comprising:

a structural frame supporting a fork bar and a swing bar, the fork bar and the swing bar each having a longitudinal axis and the longitudinal axis of the fork bar being parallel to the longitudinal axis of the swing bar;

a fork tine mounted to the fork bar and swingable relative thereto;

a lock mechanism on the fork tine which can selectively engage with the swing bar, and when engaged with the swing bar, the fork tine cannot swing relative to the fork; and the swing bar being removable from the structural frame and disengaged from the lock mechanism.

2. The pallet fork according to claim 1, wherein the structural frame comprises: a top tube and a bottom tube, and one of the top tube and the bottom tube is configured to store the swing bar.

3. The pallet fork according to claim 2, wherein the structural frame further comprises:

an end plate joining the top tube and the bottom tube;

an inner rib joining the top tube and the bottom tube; and wherein the swing bar is supported on the structural frame by a pair of aligned bores formed in the end plate and the inner rib.

4. The pallet fork according to claim 3, wherein the structural frame further comprises: an outer rib positioned between the inner rib and the fork tine, and the outer rib joins the top tube to the bottom tube.

5. The pallet fork according to claim 4, wherein the outer rib is at an angle relative to a longitudinal centerline of the pallet fork.

6. The pallet fork according to claim 5, wherein the angle is between 5 and 15 degrees.

7. The pallet fork according to claim 6, wherein the fork tine comprises a vertical leg having an upper portion and a lower portion, the upper portion being offset from the lower portion from the center line of the fork tine.

8. The pallet fork according to claim 7, further comprising: a pair of manual sliding bores attached to the vertical leg of the fork tine.

9. The pallet fork according to claim 2, wherein one of the top tube and the bottom tube comprises a bore for storing the swing bar.

10. A method of making a fork tine swingable in a pallet fork comprising:

removing a swing bar positioned parallel to a fork bar which supports the fork tine by sliding the swing bar out of a structural frame in a direction parallel to the longitudinal axis of the fork bar, the removal of the swing bar disengaging the swing bar from a lock mechanism mounted to the fork tine.

11. The method according to claim 10, further comprising: sliding the swing bar out of the structural frame, and storing the swing bar in bottom tube of the structural frame by placing the swing bar in a bore of the bottom tube.

12. The method according to claim 10, wherein the swingable fork tine further comprises: a vertical leg having an upper portion and a lower portion, and a fork spread of the fork tine being adjusted by manually adjusting a pair of manual sliding bores attached to the upper portion of the vertical leg of the fork tine.

* * * * *